United States Patent [19]

McIntire et al.

[11] Patent Number: 4,808,004

[45] Date of Patent: Feb. 28, 1989

[54] MIXING APPARATUS

[75] Inventors: William R. McIntire; James C. Ritter, both of Tulsa, Okla.

[73] Assignee: Dowell Schlumberger Incorporated, Tulsa, Okla.

[21] Appl. No.: 190,701

[22] Filed: May 5, 1988

[51] Int. Cl.[4] ..... B01F 15/02

[52] U.S. Cl. ..... 366/155; 366/30; 366/317

[58] Field of Search ..... 366/154, 155, 263, 264, 366/265, 279, 315, 317, 316, 184, 13, 30, 64

[56] References Cited

U.S. PATENT DOCUMENTS

| | | | |
|---|---|---|---|
| 3,256,181 | 6/1966 | Zingg | 366/142 |
| 3,326,536 | 6/1967 | Zingg | 366/17 |
| 3,400,914 | 9/1968 | Benassi | 366/155 |
| 3,423,075 | 1/1969 | Knudsen | 366/184 |
| 3,502,305 | 3/1970 | Grun | 366/317 |
| 4,453,829 | 6/1984 | Althouse | 366/13 |
| 4,614,435 | 9/1986 | McIntire | 366/263 |
| 4,671,665 | 6/1987 | McIntire | 366/263 |

*Primary Examiner*—Robert W. Jenkins

*Attorney, Agent, or Firm*—S. A. Littlefield

[57] ABSTRACT

This invention is directed to a mixing apparatus for mixing liquids and particulate solids which comprises an enclosed cylindrical housing with an inlet means and a liquid/solid outlet means coupled to said housing and a slinger disposed within said housing which comprises a flat disc with a plurality of circumferentially spaced vertical vanes and a cylindrical outer wall at the outer periphery of the cylindrical flat disc.

10 Claims, 2 Drawing Sheets

MIXING APPARATUS

BACKGROUND OF THE INVENTION

This invention relates to a mixing apparatus for continuously mixing solid particles with liquids, and more specifically the apparatus is useful as a mixer wherein the sand or particles similar to sand are blended with a liquid and the resulting slurries are used for treating oil wells in petroleum recovery operations.

More specifically, the mixing apparatus of this invention useful, for example, in gas and oil recovery operations comprises a mixing chamber or circular housing and a slinger including a disc configuration with a plurality of vertical, upstanding blades or vanes mounted on the surface of the disc and a circumferential wall on the outer periphery thereof. The slinger is enclosed within the mixing chamber or circular housing and fastened to the end of a drive shaft rotated by a motor, e.g., an electric or hydraulic motor, located above the housing. A hopper, e.g., a funnel, is mounted above an inlet eye in the top of the housing for introducing solid particles, such as sand or the like, into the housing. Near the bottom of the circular housing is an inlet with a pump, e.g., a centrifugal pump, for pumping liquid into the housing, with the resulting liquid/solid mixture being discharged through an outlet located approximately opposite the inlet side of the housing.

During normal operations of the mixing apparatus, sand or other solid particles flow from the hopper in a continuous manner into the rotating slinger through the inlet eye at the center of the top of the housing. The slinger is rotated while the centrifugal pump passes liquids through the inlet and thoroughly mixes with the solid materials being thrown in an outward direction, i.e., in a centrifugal action from the slinger. The solid/-liquid mixture is continuously discharged under regulated pressure through the outlet of the housing.

In general, oil and gas wells are fractured by introducing various compositions including solids and liquids into the well in a series of operations. One of these operations includes introducing a solid granular or particulate material which is thoroughly intermixed with a liquid prior to being pumped into the well formation. For example, in hydraulic fracturing, a mixture is pumped under pressure deep into the subsurface formation through a perforated well casing to fracture the surrounding rock. After the liquid portion comprising polymeric materials is withdrawn from the formation, the solid is left to prop open the fracture, thereby allowing gas or oil to flow through the fracture to the well bore and to the pipeline for distribution.

Heretofore, conventional blending apparatus required various processes for mixing large quantities of solids and liquids in order to maintain the composition in suspension when pumped over extended distances necessary to fracture the subsurface formations. For example, in U.S. Pat. No. 3,256,181, the liquid and particulate materials are intermixed by swirling the liquid, with the solids being introduced near the center of the rotation, and discharging the mixture through an impeller under sufficient velocity to cause intimate mixture of the materials. In U.S. Pat. No. 4,453,829, sand, for example, is blended with a gel to obtain a fluid mixture suitable for treatment of oil wells. The blender comprises a slinger with an impeller enclosed in a housing. The slinger and impeller are fastened together, with the impeller positioned beneath the slinger. The slinger has a toroidal configuration, and the impeller has a vortex configuration, with the slinger having a larger surface area than the impeller. The shape of the slinger and its size contribute to the pressure balance within the fluid composition as it circulates inside the housing during the mixing operation.

U.S. Pat. No. 3,256,181 discloses a mixing apparatus comprising an impeller disposed within a circular housing having a peripheral outlet and at least one peripheral inlet, in addition to an eye inlet opposite the longitudinal axis of the impeller. The solids and liquids are mixed by rotation of the impeller within the housing, while the fluid is supplied into the peripheral inlet at less pressure than that which is inherently generated within the mixer while solids are supplied through the eye of the impeller.

U.S. Pat. No. 3,423,075 discloses a mixing device for mixing various wet and dry materials which comprises a substantially cylindrical casing defining a mixing chamber into which the components are fed. The dry components are added to the mixing chamber through a funnel-shaped apparatus located at the top and center of the casing, while the wet component is fed through a plurality of feed pipes located at the top of the casing at the base of the funnel, thereby allowing the dry component to be always fed into the mixing chamber in the presence of the liquid. The mixing of the components is accomplished with a floating impeller characterized by a disc supported in a substantially horizontal plane in the mixing chamber on the lower extremity of a drive shaft projecting upward through the funnel. The upper surface of the disc is provided with a plurality of upstanding or vertical vanes, with the impeller being the only moving part of the mixing device which functions as a pump for positively forcing the mixture out of the casing to a discharge pipe, which is substantially vertically above the casing so as to provide hydrostatic pressure in the mixing chamber.

In comparison with the above-described prior art, the mixing apparatus of the present invention comprises a circular housing and a slinger including a flat bottom disc, a plurality of upstanding vertical vanes or blades with an outer cylindrical wall at the outer periphery of the disc. The blades may have the configuration of either a flat or a curved surface as they extend inward toward the center of the flat bottom disc. In the present mixing apparatus, the function of the ordinary impeller is replaced with an external pump, e.g., a centrifugal pump, controlled by variable speeds to maintain the discharge pressure of the solid/liquid mixture. By replacing the function of the impeller with the centrifugal pump, the mixing apparatus of this invention solves two major problems presently encountered in cement blenders.

More specifically, in most blenders, e.g., cement blenders, there is generally an inadequate eye diameter at the lower speeds of the impeller with a loss of prime at the higher rates of speed. In the instant mixing apparatus, however, the slinger with its outer wall creates a spinning open eye wherein the solids, e.g., proppants, are added to the swirling liquids in comparison to the closed system blenders, where the solids are incorporated by means of an impeller and an external suction pump; see U.S. Pat. Nos. 3,256,181 and 3,326,536.

In comparison, to increase the diameter of the eye for introducing solids, the instant apparatus uses an open slinger in the mixing chamber in combination with an external centrifugal or suction pump. The open slinger is rotated at speeds sufficiently high to hold back the desired discharge pressures. This is accomplished by using a slinger which comprises a flat disc with vertical vanes or blades and, more important, a cylindrical outer wall attached to the outer periphery of the flat disc. The flat disc with the vertical blades and the cylindrical outer wall creates an effective dead space near the outer wall. This structure makes the equipment less expensive in that the slinger will not wear out as frequently, since the solids, e.g., the proppants, fill the dead space created by the cylindrical wall, which provides protection from wear. The external pump is preferably a centrifugal pump with speed controls to maintain the discharge pressure of the mixer. Fluids from this pump flow into the mixing chamber of the housing tangentially or through nozzles which direct the stream and thereby achieve a swirling motion. By separating the slinger from the function of the impeller, the instant mixing apparatus essentially avoids two main problems. First is the inadequate diameter of the eye at low speeds, and the second is the loss of prime at the higher speeds. Moreover, it is possible also to increase the fluid flow rate capability of the mixer by increasing the size of the pump and/or the speed. Thus, not only is the instant mixer less costly to maintain because of the design, but it also has increased mixing capabilities.

There are many advantages in changing the design of the slinger, e.g., from a toroidal, concave, upward flow to a flat base disc with vertical or upstanding vanes with an outer wall which holds back the pressure to adequately mix the liquid with the solids. The flat disc slinger of this invention is less costly to maintain and more efficient to operate because of the cylindrical wall at the outer edge of the upstanding vanes where a dead space is created to which the solids, e.g., proppants, are added during the mixing operation.

Accordingly, one aspect of this invention is to provide a mixing apparatus capable of forming enlarged eye diameters for introducing solids in an open slinger in combination with an external pump.

Another aspect of this invention is a mixing apparatus comprising a slinger having a flat disc with a cylindrical outer wall capable of being rotated at speeds sufficient to hold back the discharge pressures which creates a dead space near the wall and prevents wear during the mixing operation.

It is an advantage of this invention to provide a mixing apparatus comprising a cylindrical housing and a slinger with an external pump which directs fluids tangentially into the housing to achieve a swirling action.

It is a still further advantage of this invention to provide a mixing apparatus comprising a cylindrical housing and a slinger wherein the impeller's function is replaced by a pump which adequately forms the eye diameter at low rates of speed and avoids the loss of prime at the higher rates of speed.

These and other characteristics of the invention will become more apparent from a further and more specific description of the invention as follows.

SUMMARY OF THE INVENTION

In general, the mixing apparatus of this invention comprises a device for forming a homogeneous, uniform mixture of various components, including liquids and solids, by rotating a slinger within a circular housing having a peripheral outlet and at least one peripheral inlet. The solids and liquids are thoroughly mixed by rotating the slinger within the housing while fluid is supplied into the peripheral inlet with less pressure than the pressures generated within the mixer while solids are added through the eye of the slinger.

The mixing apparatus preferably comprises a substantially cylindrical housing which defines a mixing chamber into which the liquid and solids are added. A tube or cone-shaped funnel is located at the top and at the center of the housing to which solids are added and enter the opening or aperture in the top center of the housing. The solid and liquid components are mixed by means of the rotating slinger characterized as a flat bottom disc supported in a substantially horizontal plane in the mixing chamber or housing on the lower end of a drive shaft which projects downwardly through the funnel into the housing. The upper surface of the flat disc has a plurality of upstanding or vertical vanes, i.e., flat or curved blades, equally spaced circumferentially on the upper surface of the disc with a cylindrical wall on the periphery or outer edge of the disc. The slinger is the only moving part of the mixing apparatus which, together with the pump, mixes and then moves the admixed components out of the housing through a discharge pipe or outlet.

DETAILED DESCRIPTION OF THE PREFERRED EMBODIMENT

Figure 1:
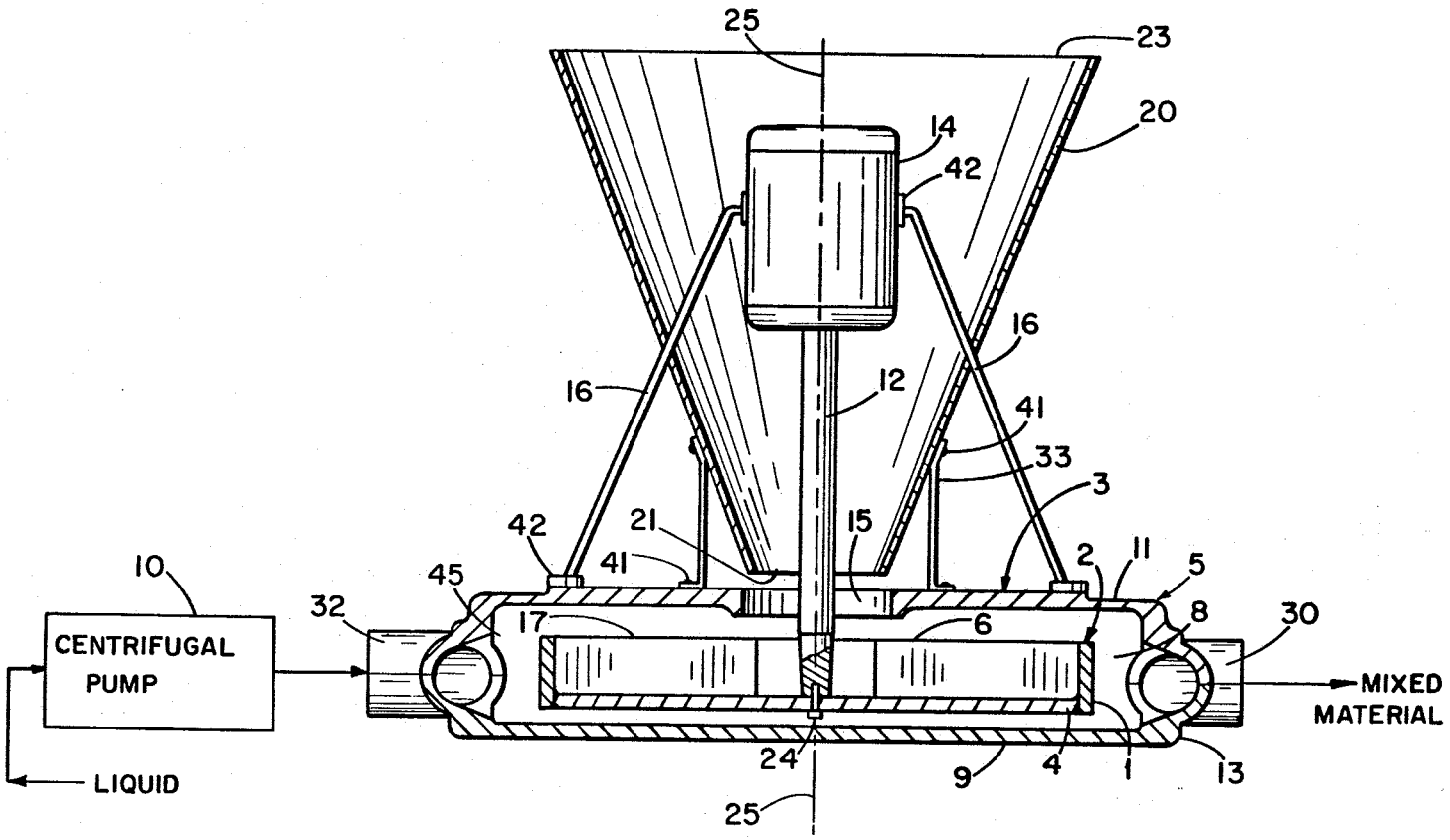
FIG. 1 is a vertical cross-sectional view of the mixing apparatus of this invention.

In general, referring to the drawings, the mixing apparatus of this invention comprises a substantially cylindrical housing including a cylindrical inner side wall with a generally circular bottom plate and a generally circular top plate. The cylindrical housing has a peripheral outlet and at least one peripheral inlet and an eye inlet or aperture in the center of the top plate of the housing. Solids and liquids are mixed in accordance with this invention by rotating a slinger disposed within the housing while the fluid or liquid is supplied through the peripheral inlet at a pressure less than the pressure generated by the slinger and while the solids are added through the eye of the slinger by means of a feed tube or hopper. The admixture of the liquids and solids is removed from the housing of the mixing apparatus through the peripheral outlet by means of the pump and slinger.

More specifically, referring to FIG. 1 of the drawings, the mixing apparatus of this invention is generally illustrated by the number 3, which comprises a substantially cylindrical shaped housing 5 provided with a peripheral inlet 32 into which liquids are pumped and a peripheral outlet 30. The inlet 32 is disposed such that the liquids pumped into the chamber 45 of the housing 5 flow substantially tangentially along the inner cylindrical side wall 8 of the housing 5, flowing circumferentially within said housing to the peripheral outlet 30, which is also disposed tangentially along the inner cylindrical side wall 8 and is essentially located opposite the peripheral inlet 30. The inlet 32 and outlet 30 are openings in the side wall 8 of the cylindrical housing 5 which are essentially equal in size or diameter to facilitate the removal of the mixed material from the housing.

The housing 5 comprises a generally circular or cylindrical top plate or wall 11 coaxial with the horizontal axis of housing 5. The top plate or wall 11 of the housing is provided with a relatively large eye inlet or aperture 15 at the center which opens into the mixing chambers 17 of the slinger 2. Over the top of the upper plate 11, directly over the central aperture or eye inlet 15, is a feed means, e.g., a funnel or hopper, mounted onto the top of the housing 5 with two or more brackets 33 with bolts 41, with a bottom opening 21 equivalent to about the size of aperture 15 for adding dry or solid components to the slinger 2 disposed in the housing 5.

In the specific embodiment shown in FIG. 1, the feed means 20 comprises a funnel wherein the inside diameter at the bottom of the funnel opening 21 corresponds substantially to the diameter of the eye inlet or aperture 15 located in the top of the plate 11 of the housing 5 to form an unobstructed passageway into the slinger 2. The slope of the walls of the funnel 20 is preferably about 30 to 75 degrees with respect to the vertical axis 25 of the drive shaft 12. It is understood, however, that the slope of the funnel is not critical but can be any degree, e.g., 45 degrees, and that the diameter of the mouth 23 of the funnel 20 may range from about one to fifty times the diameter of the bottom opening 21 of the funnel 20.

Referring to FIG. 1, the substantially circular or cylindrical housing 5 is provided with means, such as a centrifugal pump 10, for feeding the liquid components into the slinger 2 of the circular or cylindrical housing 5. A thorough mixing of the wet and dry components is accomplished by means of the slinger 2, which comprises an essentially flat, generally circular bottom disc 4 connected to a central drive shaft 12 with a pin or bolt 24 and a plurality of upstanding blades or vanes 6 substantially equally spaced circumferentially on said flat bottom disc 4 with the bottom edges of said vanes 6 being integral with the top surface of said flat disc. The vanes 6 have a horizontal length less than the radius of said flat bottom disc 4 with the substantially cylindrical outer wall 1 extending upward from the outer periphery of the bottom disc 4 to substantially the same height of the vanes 6. The diameter of the flat bottom disc 4 of the slinger 2 is less than the diameter of the circular top and bottom plates 9 and 11 of the cylindrical housing 5.

Figure 2:
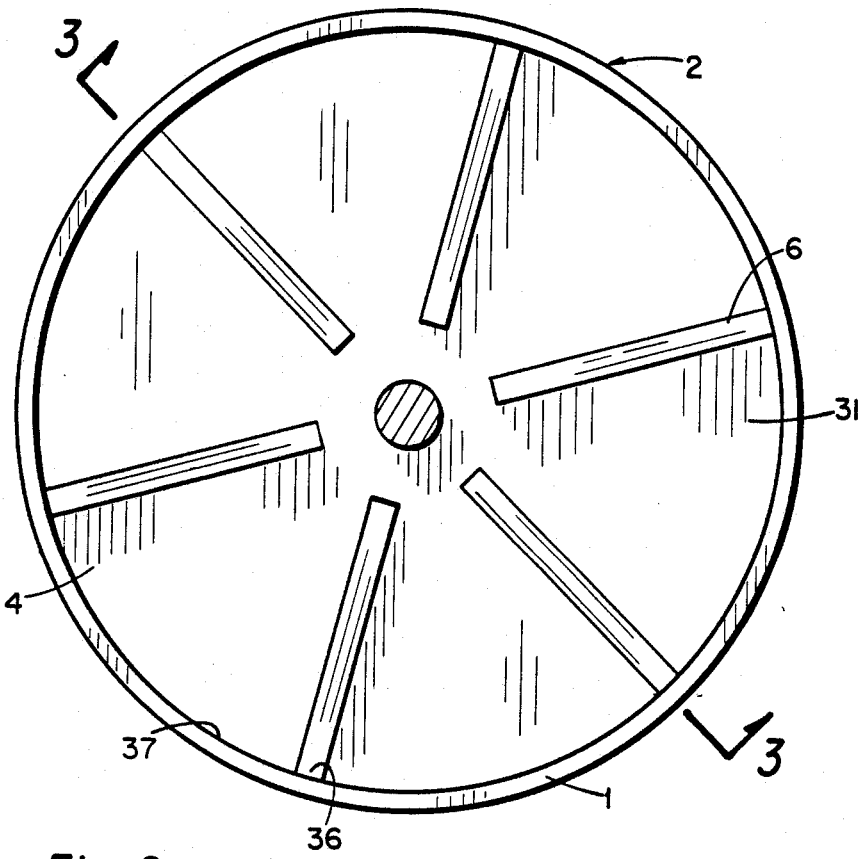
FIG. 2 is a top or plan view of the slinger as shown in FIG. 3.
Figure 3:
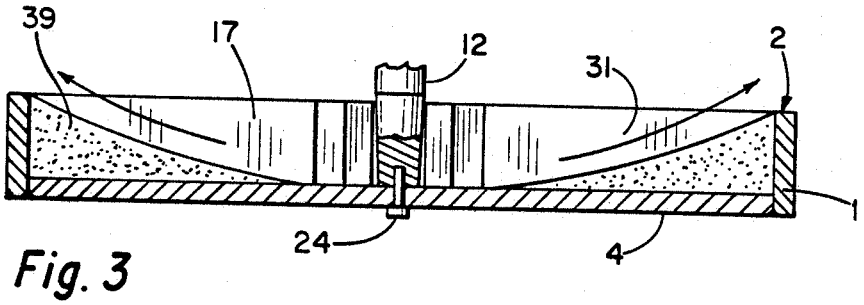
FIG. 3 is a vertical, cross-sectional view of the slinger taken along the line 3—3 of FIG. 2.

As shown in FIGS. 2 and 3, in accordance with this invention, it was found that the slinger 2, having a plurality of circumferentially spaced, upstanding vanes 6 extending from the surface of the flat bottom disc 4, caused the dry and wet components added to the housing 5 to be held between the vanes 6 of the slinger and the generally cylindrical outer wall 1, thereby maintaining intimate contact between the liquids and solids for thorough blending during rotation. As shown in FIG. 1, the slinger 2 is capable of being rotated at desired speeds by any power means, e.g., an electric or hydraulic motor 14, mounted above the housing 5 over the central aperture 15 with two or more brackets 16 and bolts 42 and connected to the slinger 2 by shaft 12, with the lower end thereof being connected to the cylindrical bottom disc 4 by means of a pin or bolt 24.

As shown in FIGS. 2 and 3, in accordance with this invention, the design of the slinger 2 allows for a more rapid and thorough mixing of the wet and dry components 39 by creating a dead space 31 near the outer wall 1 which prevents wear on the slinger because of the presence of the solid material which fills the space. The thoroughly mixed solids and liquids are discharged from the housing 5 by the pumping action of the pump 10 through a tangential discharge or outlet 30 in the cylindrical wall of the housing. As an alternative, the blades or vanes 6 standing vertical off the surface of the flat disc 4 may be in the form of radially extending blades where each blade is curved or bowed along its length and terminates at its outer vertical edge 36 flush with the inner surface 37 of the outer cylindrical wall 1. The blades should be bowed in the direction of rotation of the slinger 2, which forces the solid materials toward an outward direction as it is driven through the housing 5 under centrifugal force into the moving liquid.

While this invention has been shown and described with respect to a particular embodiment, it is obvious that there are other variations and modifications of the specific embodiment as shown and described herein which will be apparent to those skilled in the art and are intended to be within the spirit and scope of the invention as set forth in the appended claims.

The invention claimed is:

1. A mixing apparatus for mixing liquids and particulate solids, which comprises an enclosed generally cylindrical housing having a generally cylindrical inner side wall, a generally circular bottom plate, a generally circular top plate;

at least one liquid inlet means and an outlet means coupled to the said cylindrical wall, and a particulate solids inlet aperture centrally disposed in the top plate of said housing and a rotatable slinger; said slinger being disposed within said housing and spaced from said cylindrical wall and said top and bottom plates;

said slinger comprising a flat generally circular bottom disc with a plurality of circumferentially spaced vertical vanes and a generally cylindrical outer wall mounted at the outer periphery of said flat bottom disc; said mixing apparatus including a drive means to rotate said slinger in said cylindrical housing to admix solids and liquids.

2. The mixing apparatus of claim 1, further characterized in that the liquid inlet means includes a pump.

3. The mixing apparatus of claim 2, further characterized in that the slinger comprises a substantially flat circular disc with a plurality of equally spaced vertical vanes spaced circumferentially on said disc with the bottom edges of said vanes being integral with the surface of the disc.

4. The mixing apparatus of claim 3, further characterized in that the horizontal length of the vertical vanes is less than the radius of the circular flat bottom disc.

5. The mixing apparatus of claim 3, further characterized in that the cylindrical outer wall extends upward from the outer periphery of the flat bottom cylindrical disc to substantially the same height as the vanes.

6. The mixing apparatus of claim 1, further characterized in that the circumferentially spaced vertical standing vanes are curved along the length and terminate at the outer vertical edge flush with the inner surface of the outer cylindrical wall mounted on the outer periphery of the flat bottom disc.

7. The mixing apparatus of claim 1, further characterized in that the diameter of the flat bottom disc of the slinger is less than the diameter of the top and bottom plates of the cylindrical housing.

8. The mixing apparatus of claim 1, further characterized in that a feed means is mounted to the top of the housing directly over the central aperture in the top plate of the housing.

9. The mixing apparatus of claim 8, further characterized in that the feed means includes a hopper.

10. The mixing apparatus of claim 1, further characterized in that the drive means capable of rotating the slinger within said cylindrical housing comprises a motor in combination with a drive shaft attached at about the center of the flat bottom disc of the slinger.

* * * * *